US009556658B2

(12) United States Patent
Jung et al.

(10) Patent No.: US 9,556,658 B2
(45) Date of Patent: Jan. 31, 2017

(54) DOOR CHECKER FOR VEHICLE

(71) Applicants: Hyundai Motor Company, Seoul (KR); Pusan National University Industry-University Cooperation Foundation, Busan (KR)

(72) Inventors: Yoong Ho Jung, Busan (KR); Hyung Don Kim, Incheon (KR); Sung Min Son, Busan (KR)

(73) Assignees: Hyundai Motor Company, Seoul (KR); Pusan National University Industry—University Cooperation Foundation, Busan (KR)

( * ) Notice: Subject to any disclaimer, the term of this patent is extended or adjusted under 35 U.S.C. 154(b) by 0 days.

(21) Appl. No.: 14/570,995

(22) Filed: Dec. 15, 2014

(65) Prior Publication Data

US 2016/0032634 A1 Feb. 4, 2016

(30) Foreign Application Priority Data

Aug. 4, 2014 (KR) ..... 10-2014-0099797

(51) Int. Cl.

| | |
|---|---|
| ***E05D 11/00*** | (2006.01) |
| ***E05D 11/10*** | (2006.01) |
| *E05D 5/12* | (2006.01) |

(52) U.S. Cl.

CPC ..... *E05D 11/1071* (2013.01); *E05D 11/1057* (2013.01); *E05D 5/121* (2013.01); *E05Y 2600/10* (2013.01); *Y10T 16/54025* (2015.01)

(58) Field of Classification Search

CPC ..... Y10T 16/54025; Y10T 16/54038; Y10T 16/304; Y10T 16/5403; Y10T 16/540257; Y10T 16/5385; Y10T 16/54028; Y10T 16/551; E05D 11/1071; E05D 11/1057; E05D 2011/009; E05D 11/084; E05D 5/121; E05C 21/005; E05Y 2900/531; E05Y 2600/10; E05F 3/20

(Continued)

(56) References Cited

U.S. PATENT DOCUMENTS 7,076,836 B1 * 7/2006 Butka ..... E05C 21/005 16/334
7,461,432 B2 * 12/2008 Lowen ..... E05D 11/1071 16/334

(Continued)

FOREIGN PATENT DOCUMENTS

JP 57-82564 U 5/1982
JP 5-44636 U 6/1993

(Continued)

*Primary Examiner* — William Miller
(74) *Attorney, Agent, or Firm* — Morgan, Lewis & Bockius LLP

(57) ABSTRACT

A door checker for a vehicle includes a hinge rotatably connecting a door to a vehicle body and having a shaft, a slider penetratingly inserted into the shaft and linearly moving with rotational force of the shaft, and a checking unit linearly reciprocating in a radial direction of the shaft by the slider. By implementing a manipulation feeling in opening and closing a door by increasing a section for checking the door by converting a rotational movement of the door into a linear movement based on a screw principle, operability can be improved to enhance marketability, and durability can be enhanced by increasing the section for implementing operating force for opening and closing a door.

7 Claims, 8 Drawing Sheets

(58) Field of Classification Search
USPC ... 16/327, 342, 50, 337, 332, 334, 297, 374, 16/340; 296/146.11
See application file for complete search history.

(56) References Cited

U.S. PATENT DOCUMENTS

| | | | | |
|---|---|---|---|---|
| 7,891,054 | B2 * | 2/2011 | Nicolas Domingo | E05D 11/084 16/303 |
| 8,108,969 | B2 * | 2/2012 | Ochiai | E05D 11/1057 16/334 |
| 8,689,403 | B2 * | 4/2014 | Lowen | E05D 11/1071 16/309 |
| 2007/0050940 | A1 * | 3/2007 | Lowen | E05D 11/1071 16/334 |
| 2009/0293228 | A1 | 12/2009 | Sasa | |
| 2010/0064479 | A1 * | 3/2010 | Nicolas Domingo | E05D 11/084 16/348 |
| 2012/0233814 | A1 * | 9/2012 | Minegishi | E05D 11/1057 16/332 |
| 2012/0246875 | A1 * | 10/2012 | Lowen | E05D 11/1071 16/337 |

FOREIGN PATENT DOCUMENTS

| | | | |
|---|---|---|---|
| JP | 2005-264616 | A | 9/2005 |
| KR | 20-0353440 | Y1 | 6/2004 |
| KR | 10-2013-0088269 | A | 8/2013 |
| KR | 10-2014-0028478 | A | 3/2014 |
| KR | 10-2014-0089085 | A | 7/2014 |

* cited by examiner

DOOR CHECKER FOR VEHICLE

CROSS-REFERENCE TO RELATED APPLICATION

The present application is based on and claims the benefit of priority to Korean Patent Application No. 10-2014-0099797, filed on Aug. 4, 2014, the entire contents of which is incorporated herein for all purposes by this reference.

BACKGROUND OF THE INVENTION

Field of the Invention

The present disclosure relates to a door checker for a vehicle and, more particularly, to a door checker for a vehicle capable of implementing a manipulation feeling in opening and closing a door of a vehicle by increasing a section for checking a door by converting a rotational movement of the door into a linear movement.

Description of-Related Art

In general, a door of a vehicle is installed in a vehicle body by the medium of a door hinge, and rotates on the door hinge so as to be opened and closed.

When a driver gets in or gets off a vehicle through a door or when objects are loaded or unloaded, the door needs to be stably maintained in an open state so that the driver can easily get in or get off or objects can be easily loaded or unloaded. However, a door hinge merely serves to maintain an installed state of a door and enables the door to rotate to be opened and closed, without providing a role of maintaining an open state at a predetermined angle in the course of an opening and closing path of the door.

Thus, in a vehicle, a door checker device is installed in a central portion of a lateral surface in front of an inner panel of a door to enable the door to be maintained in a stopped state at two or three points in the course of opening and closing path of the door.

Conventionally, as illustrated in FIG. 1, a hinge-integrated checker is provided. A rotary slider 1 is mounted on a hinge shaft so that when a door is opened, the hinge shaft is moved and the rotary slider 1 is moved at the same angle, and here, an amount of rotation of the rotary slider 1 is determined depending on a degree of opening of the door.

As a result, when the degree of opening of the door is 70 degrees, a recess 3 implementing operating force in an operation section of the rotary slider 1 by the 70 degrees may be formed, and thus, operating force may be implemented in an approximately 10 to 15 mm section.

However, the related art hinge-integrated checker has a structure in which operating force of the door is implemented as a cylindrical protrusion 2 passes on the recess 3 of the rotary slider 1. Namely, since operating force should be implemented within a short section, the section between stages is shortened, lowering durability, and several stages of stops is not possible to implement, degrading operability.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a door checker for a vehicle capable of implementing a manipulation feeling in opening and closing a door of a vehicle by increasing a section for checking a door by converting a rotational movement of the door into a linear movement.

According to an exemplary embodiment of the present disclosure, a door checker for a vehicle includes a hinge rotatably connecting a door to a vehicle body and having a shaft, a slider penetratingly inserted onto the shaft and linearly moving along the shaft with rotational force of the shaft, and a checking unit linearly reciprocating in a radial direction of the shaft by the slider.

Threads may be formed on an outer circumferential surface of the shaft, and threads corresponding to the thread of the shaft may be formed on an inner circumferential surface of the slider.

An indented surface may be formed on an outer surface of the slider, and a coupling protrusion corresponding to the indented surface may be formed on one surface of the checking unit.

The checking unit may be provided within a housing, and an elastic member may be additionally provided between the checking unit and an inner surface of the housing.

A plurality of recesses may be formed on the indented surface of the slider.

The shaft may include a first shaft and a second shaft which are coupled in a vertical direction, and shaft recesses each having a thread shape may be formed on the first shaft and the second shaft.

Shaft protrusions corresponding to the shaft recesses of the first shaft and the second shaft may be formed within the slider to enable the slider to move along the shaft.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
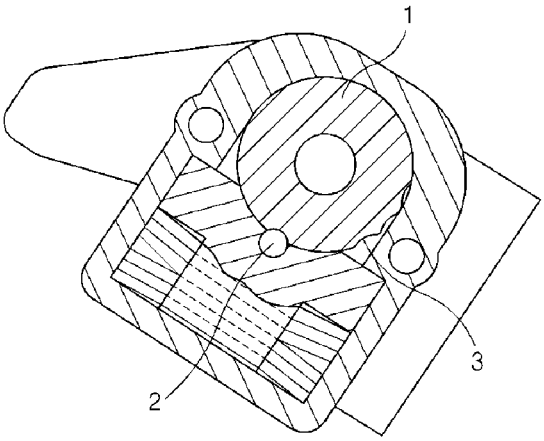
FIG. 1 (Prior Art)
FIG. 1 is a view illustrating a related art hinge-integrated checker.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present disclosure will be described in detail with reference to the accompanying drawings.

As illustrated in FIGS. 2 through 5, a door checker for a vehicle according to an exemplary embodiment of the present disclosure includes a hinge 100 rotatably connecting a door to a vehicle body and having a shaft 300, a slider 400 penetratingly inserted onto the shaft 300 and linearly moving along the shaft 300, and a checking unit 500 linearly reciprocating in a radial direction of the shaft 300 by the slider 400.

The hinge 100 serves to connect a door to a vehicle body, and is rotatably installed between a door and a vehicle body such that the door is operable when opened and closed.

Figure 2:
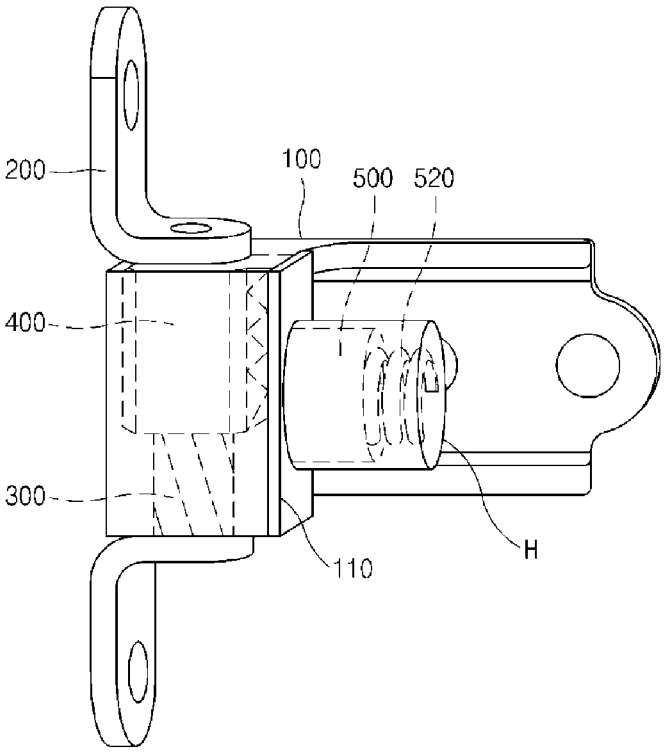
FIG. 2 is a view illustrating a door checker for a vehicle according to an exemplary embodiment of the present disclosure.
Figure 5:
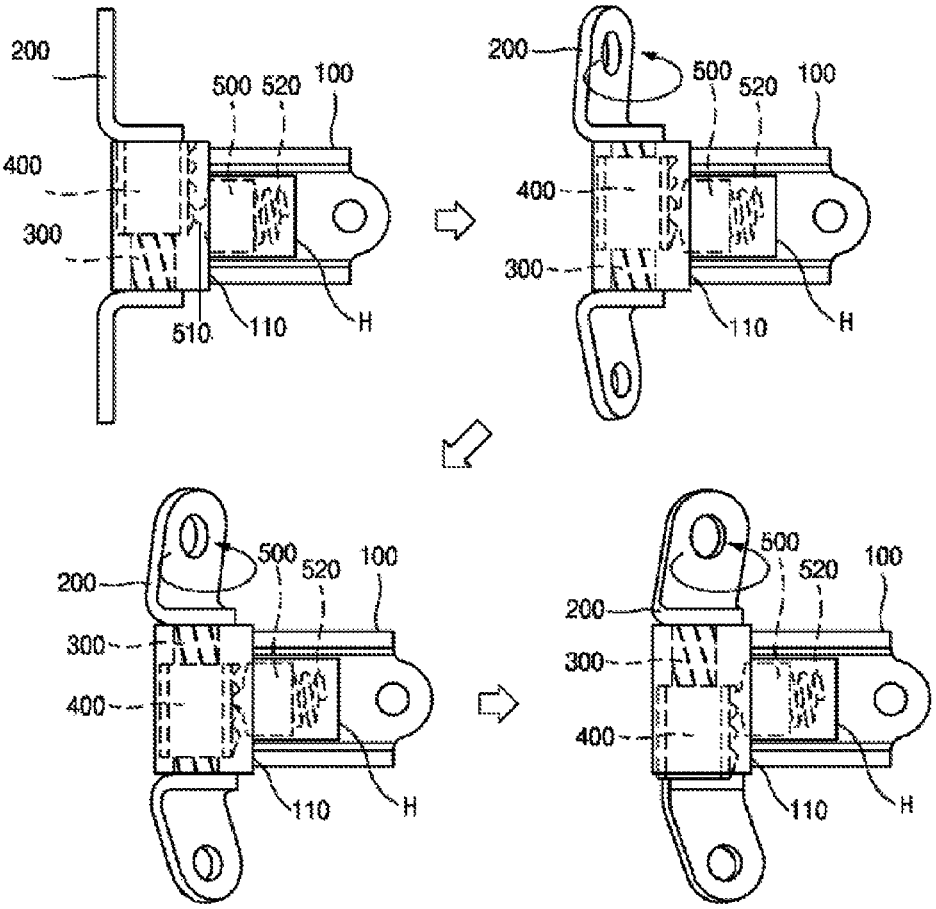
FIG. 5 is a view illustrating stepwise operations of the door checker for a vehicle to open a vehicle door in a closed state according to an exemplary embodiment of the present disclosure.

As illustrated in FIGS. 2 and 5, preferably, a space portion 110 is formed at one end of the hinge 100 to allow the shaft 300 and the slider 400 as described hereinafter to be provided therein.

Connection portions 200 are rotatably provided above and below the space portion 110 of the hinge 100 and installed in the door.

Namely, the connection portions 200 transmit rotational force generated when the door is opened and closed to the hinge 100.

Figure 3:
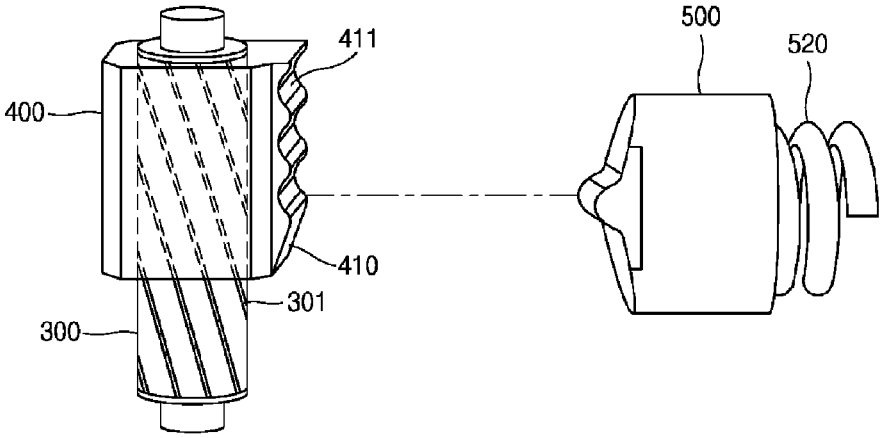
FIG. 3 is a view illustrating a coupling relationships among a shaft, a slider, and a checking unit in the door checker for a vehicle according to an exemplary embodiment of the present disclosure.
Figure 4:
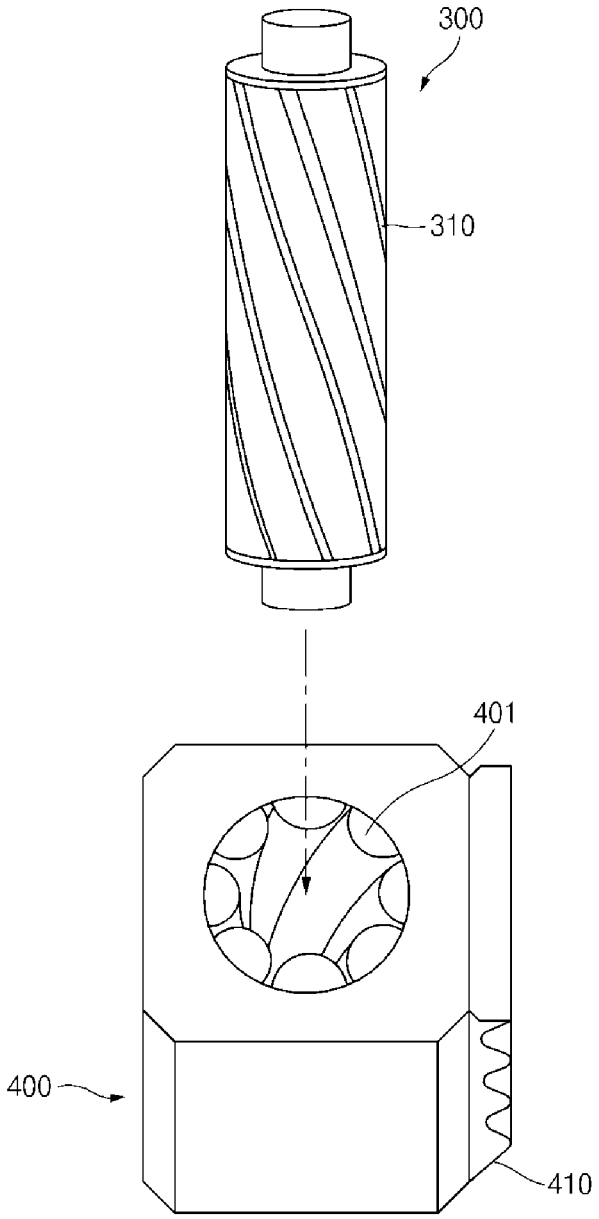
FIG. 4 is a view illustrating a coupling relationship between the shaft and the slider in the door checker for a vehicle according to an exemplary embodiment of the present disclosure.

As illustrated in FIGS. 2 through 4, the shaft 300 is penetratingly installed in the space portion 110 of the hinge 100, and both ends thereof are rotatably coupled to the connection portions 200 of the hinge 100 provided above and below at one end of the hinge 100.

The slider 400 is inserted onto an outer circumferential surface of the shaft 300 and movable along the outer circumferential surface of the shaft 300 in a vertical direction.

To this end, threads 301 are formed on the outer circumferential surface of the shaft 300 and threads 401 corresponding to the threads 301 of the shaft 300 are formed on an inner circumferential surface of the slider 400. Accordingly, when the hinge 100 rotates according to opening and closing of the door, the shaft 300 inserted in the connection portions 200 of the hinge 100 rotates and the slider 400 inserted onto the shaft 300 based on a screw coupling structure linearly moves in a vertical direction according to the rotation of the shaft 300.

The checking unit 500 is provided outside of the space portion 110 of the hinge 100. One end of the checking unit 500 is inserted into an interior of the space portion 110 so as to be positioned on an outer surface of the slider 400, according to which the slider 400 is caught by the checking unit 500 when moving in a vertical direction, thereby controlling opening and closing operations of the door.

An indented surface 410 is formed on the outer surface of the slider 400, and a coupling protrusion 510 corresponding to the indented surface 410 is formed on one surface of the checking unit 500, so that when the slider 400 moves in the vertical direction, the coupling protrusion 510 of the checking unit 500 is caught by the indented surface 410 of the slider 400.

The checking unit 500 is provided within a housing H, and an elastic member 520 may be additionally provided between the checking unit 500 and an inner surface of the housing H to elastically support the checking unit 500 and the slider 400 to enhance operating force when the slider 400, while moving in the vertical direction, is caught by the checking unit 500.

The indented surface 410 formed on an outer surface of the slider 400 may include three recesses 411 and a total length of the indented surface 410 in a vertical direction may range from 30 to 45 mm. Accordingly, when the door is opened and closed, the slider 400 may be caught three times in the section ranging from 30 to 45 mm, thereby increasing the section for generating operating force of the checker, compared with the related art.

As illustrated in FIG. 5, in a state in which the door is closed, the coupling protrusion 510 of the checking unit 500 is positioned in a lower portion of the indented surface 410 of the slider 400. In a state in which the door is opened by a first stage, the coupling protrusion 510 of the checking unit 500 is positioned in the lowermost recess among the recesses 411 formed on the indented surface 410 of the slider 400. In a state in which the door is opened by a second stage, the coupling protrusion 510 of the checking unit 500 is positioned in a central recess among the recesses 411 formed on the indented surface 410 of the slider 400. In a state in which the door is completely opened, the coupling protrusion 510 of the checking unit 500 is positioned in the uppermost recess among the recesses 411 formed on the indented surface 410 of the slider 400.

Figure 6A:
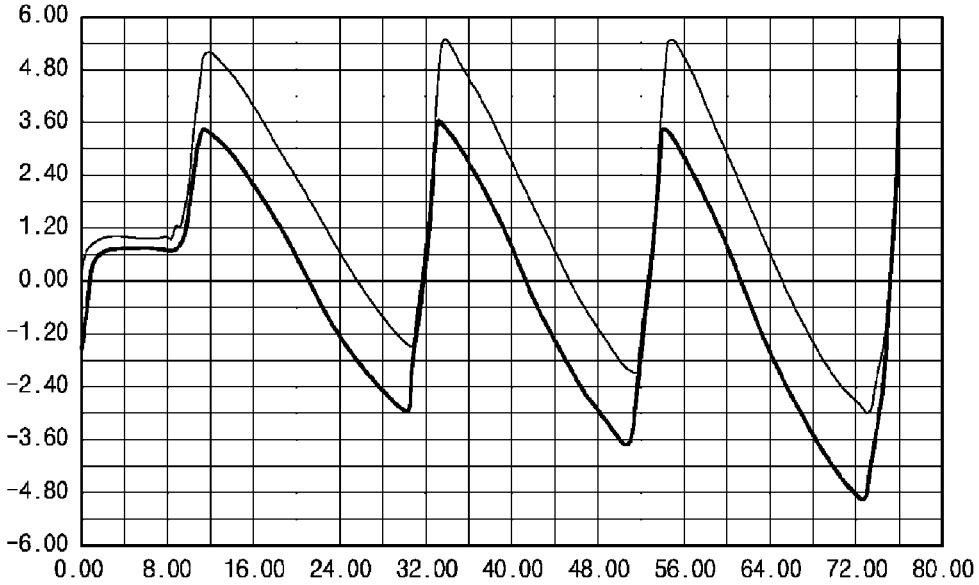
FIG. 6A (Prior Art)
FIG. 6A and FIG. 6B are graphs of experiment illustrating comparison between operating force of the door checker for a vehicle according to an exemplary embodiment of the present disclosure and operating force of the related art.
Figure 6B:
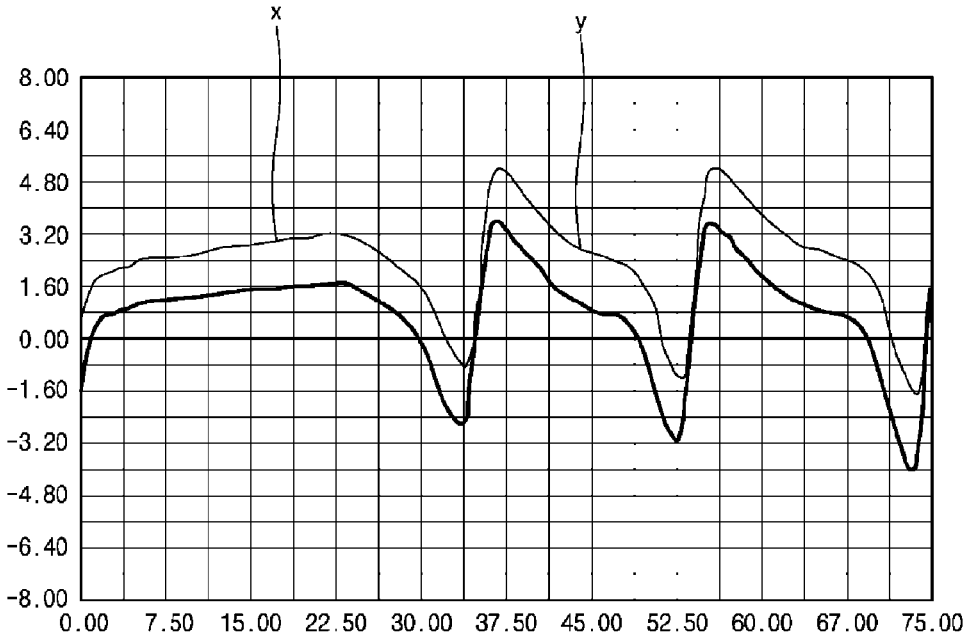

As a result, in the related art as illustrated in FIG. 6A, since operating force should be implemented in a short section, smooth lateral operating force cannot be implemented and only a simple door stop function is implemented, but in contrast, in the exemplary embodiment of the present disclosure, as illustrated in FIG. 6B, an operating force implementation section is sufficiently long and smooth lateral operating force can be implemented through a section (x) in which operating force increases smoothly and a section (y) in which operating force decreases smoothly.

Figure 7A:
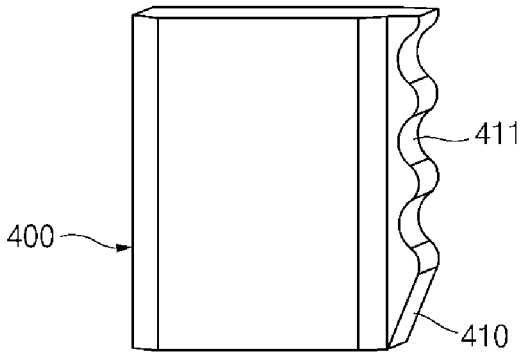
FIG. 7A, FIG. 7B, and FIG. 7C are views illustrating various examples of a slider of the door checker for a vehicle according to an exemplary embodiment of the present disclosure.
Figure 7B:
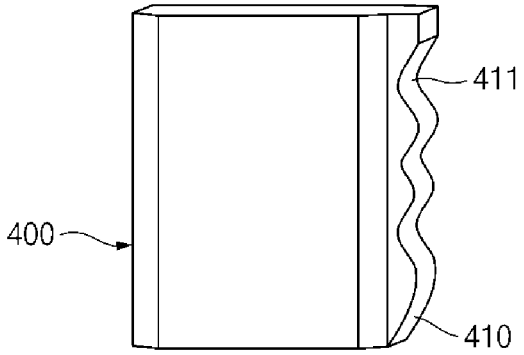
Figure 7C:
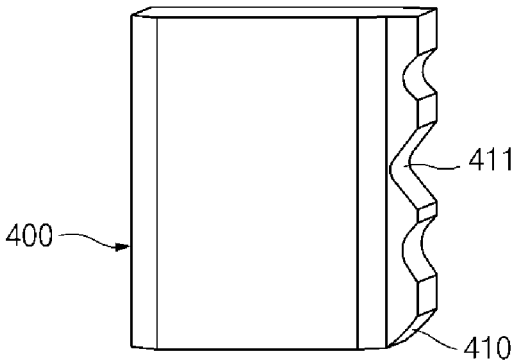
Figure 8A:
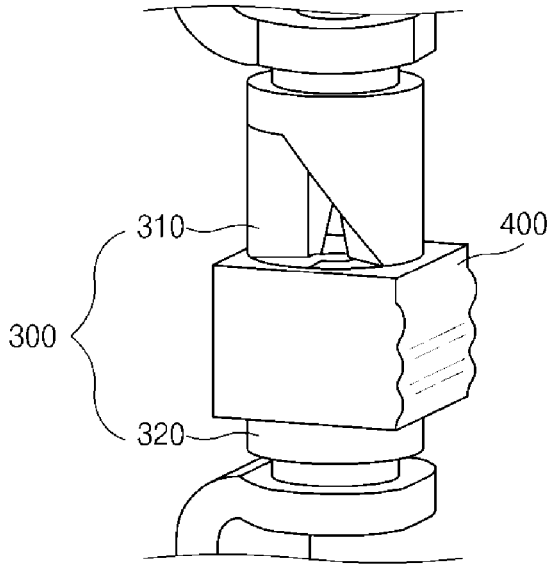
FIG. 8A, FIG. 8B, FIG. 8C, and FIG. 8D are views illustrating examples of a shaft and the slider of the door checker for a vehicle according to an exemplary embodiment of the present disclosure.
Figure 8B:
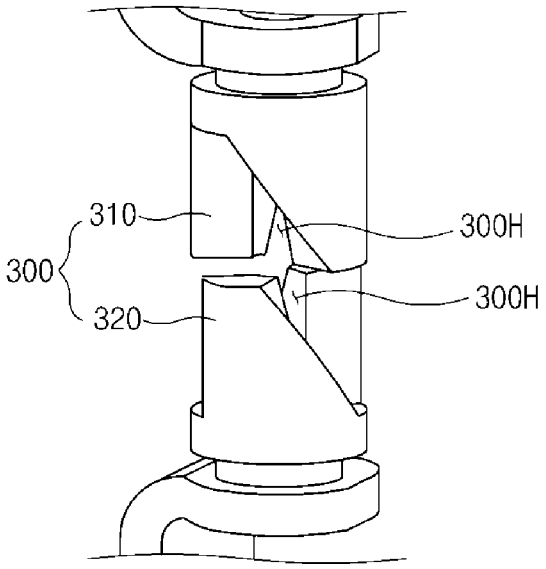
Figure 8C:
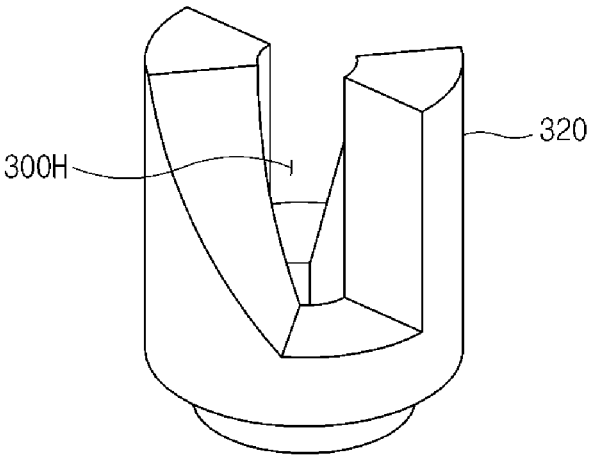
Figure 8D:
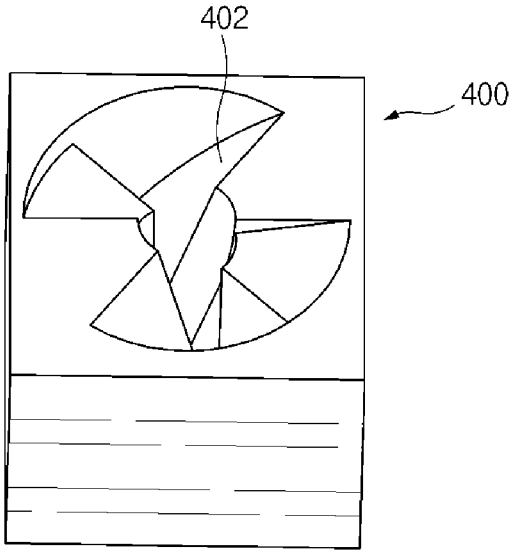

Here, as illustrated in FIGS. 7A-7C, preferably, the recesses 411 formed on the indented surface 410 of the slider 400 have various shapes to implement various operating forces.

As illustrated in FIGS. 8A-8D, the shaft 300 may include a first shaft 310 and a second shaft 320 which are coupled in a vertical direction, and shaft recesses 300H each having a thread shape may be formed on the first shaft 310 and the second shaft 320 such that the slider 400 inserted onto the shaft 300 may be moved along the shaft recesses 300H in the vertical direction.

Here, a shaft protrusion 402 inserted to correspond to the shaft recesses 300H of the first shaft 310 and the second shaft 320 may be formed within the slider 400 to enable the slider 400 to move along the shaft 300.

In this manner, the door checker for a vehicle according to the exemplary embodiment of the present disclosure uses a bolt-nut engagement principle in order to improve formation of a rotary slider recess in a short section, which is problematic in the related art. Namely, the door checker for a vehicle according to the exemplary embodiment of the present disclosure has a structure in which the nut-type slider 400 moves up and down in an axial direction when the bolt-type shaft 300 moving in the same manner as that of the hinge 100 rotates to open the door by 70 degrees.

As a result, an amount of movement of the slider 400 is determined depending on a pitch of threads of the bolt-type shaft 300, operating force is implemented in the section ranging from approximately 30 to 45 mm, the indented surface is formed on one surface of the slider 400, and the checking unit 500 forced by a spring is brought into frictional contact with the indented surface 410 to implement operating force. Thus, since the section for implementing operating force is longer than that of the related art structure, improving durability, and door stop at several stages can be implemented.

As described above, according to the exemplary embodiment of the present disclosure, by implementing a manipulation feeling in opening and closing a door by increasing a section for checking the door by converting a rotational movement of the door into a linear movement based on a screw principle, operability can be improved to enhance marketability, and durability can be enhanced by increasing the section for implementing operating force for opening and closing a door.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A door checker for a vehicle, the door checker comprising:

a hinge rotatably connecting a door to a vehicle body and having a shaft;

a slider penetratingly inserted onto the shaft and linearly moveable along the shaft with rotational force of the shaft; and a checking unit linearly reciprocating in a radial direction of the shaft by engaging the slider.

2. The door checker according to claim 1, wherein threads are formed on an outer circumferential surface of the shaft, and threads corresponding to the threads of the shaft are formed on an inner circumferential surface of the slider.

3. The door checker according to claim 1, wherein an indented surface is formed on an outer surface of the slider, and a coupling protrusion corresponding to the indented surface is formed on one surface of the checking unit.

4. The door checker according to claim 3, wherein a plurality of recesses are formed on the indented surface of the slider.

5. The door checker according to claim 1, wherein the checking unit is provided within a housing, and an elastic member is additionally provided between the checking unit and an inner surface of the housing, and wherein the checking unit includes a coupling protrusion engaging the slider to suppress the linear movement of the slider.

6. The door checker according to claim 1, wherein the shaft includes a first shaft and a second shaft which are coupled in a vertical direction, and shaft recesses each having a thread shape are formed on the first shaft and the second shaft.

7. The door checker according to claim 6, wherein shaft protrusions corresponding to the shaft recesses of the first shaft and the second shaft are formed within the slider to enable the slider to move along the shaft.

* * * * *